US006032831A

United States Patent [19]

Gardner et al.

[11] Patent Number: 6,032,831

[45] Date of Patent: Mar. 7, 2000

[54] PERSONAL HYDRATION SYSTEM WITH AN IMPROVED MOUTHPIECE

[75] Inventors: Gary D. Gardner, Atherton; Robert Choi, Gilroy, both of Calif.; Cynthia A. Peters, Burleson, Tex.

[73] Assignee: Came1Bak Products, Inc., Petaluma, Calif.

[21] Appl. No.: 09/151,493

[22] Filed: Sep. 11, 1998

Related U.S. Application Data

[63] Continuation-in-part of application No. 09/118,196, Jul. 17, 1998.

[51] Int. Cl.[7] ..... B67D 5/64

[52] U.S. Cl. ..... 222/175; 222/529; 220/703

[58] Field of Search ..... 222/175, 512, 222/527, 529, 92; 224/148.4, 148.5, 148.6; 220/703

[56] References Cited

U.S. PATENT DOCUMENTS

| | | |
|---|---|---|
| 33,343 | 9/1861 | Garrick . |
| 259,151 | 6/1882 | Holbon . |
| 274,447 | 3/1883 | Kennish . |
| D. 337,273 | 7/1993 | Thatcher . |
| D. 337,274 | 7/1993 | Thatcher . |
| 357,272 | 2/1887 | Donavin . |
| D. 398,776 | 9/1998 | Fawcett . |
| 581,767 | 5/1897 | Powers . |
| 964,620 | 7/1910 | Dana . |
| 1,272,519 | 7/1918 | Piper . |
| 1,326,966 | 1/1920 | Reeves . |
| 1,404,163 | 1/1922 | Pim . |
| 1,426,024 | 8/1922 | Thureson . |
| 1,576,430 | 3/1926 | Isbell . |
| 1,637,635 | 8/1927 | Corley . |
| 1,889,963 | 12/1932 | Cooney et al. . |
| 2,013,358 | 9/1935 | Osborne . |
| 2,095,351 | 10/1937 | Van Winkle . |

(List continued on next page.)

FOREIGN PATENT DOCUMENTS

| | | |
|---|---|---|
| 1002897 | 3/1952 | France . |
| 693272 | 6/1940 | Germany . |
| 70698 | 7/1946 | Norway . |
| 180216 | 10/1945 | Switzerland . |
| 19546 | 9/1903 | United Kingdom . |
| 323451 | 1/1930 | United Kingdom . |

OTHER PUBLICATIONS

The Integrator advertisement, FasTrak Systems, Inc., 1996.
The CamelBak Narrow Gauge System advertisement, FasTrak Systems, Inc., 1996.
The Pakster advertisement, FasTrak Systems, Inc., 1996.
The HydroBak advertisement, FasTrak Systems, Inc., 1996.
The $H_2$•Flow Advertisement, FasTrak Systems, Inc., 1996.
The Mule Advertisement, FasTrak Systems, Inc., 1996.
Camblebak Profit System Catalog, Aug., 1996.
Camelbak® Hydrate or Die® advertisement, FasTrak Systems, Inc., 1996.
Camelbak® Profit System Brochure, FasTrak Systems, Inc., Aug., 1996.

*Primary Examiner*—Gregory L. Huson
*Attorney, Agent, or Firm*—Kolisch, Hartwell, Dickinson, McCormack & Heuser

[57] ABSTRACT

A personal hydration system with an improved mouthpiece for use in providing fluid for delivery to a user. The mouthpiece includes a neck that is adapted to be mounted on a supply tube to a hydration system and which is joined to a resilient head. The head includes a dispensing face with a pair of lips that define a normally closed slit, through which fluid is dispensed from the mouthpiece, a perimeter and a minimum dimension between opposed points on the perimeter. The bite region extends from the perimeter to a shoulder, which joins the bite region and the neck. From a closed position, in which the lips extend against each other to close the slit and prevent fluid from being dispensed through the slit, the mouthpiece is deformable to a dispensing position in which the lips are spread at least partially away from each other to allow fluid to be dispensed through the lips.

18 Claims, 4 Drawing Sheets

U.S. PATENT DOCUMENTS

| | | |
|---|---|---|
| 2,144,755 | 1/1939 | Freedman . |
| 2,219,604 | 10/1940 | Trotter . |
| 2,320,906 | 6/1943 | Bent . |
| 2,328,095 | 8/1943 | Phillips . |
| 2,380,372 | 7/1945 | Alderfer . |
| 2,468,915 | 5/1949 | Bayless . |
| 2,485,442 | 10/1949 | Halliday . |
| 2,500,363 | 3/1950 | Koeppel . |
| 2,620,479 | 12/1952 | Buck . |
| 2,738,907 | 3/1956 | Lacher . |
| 2,755,480 | 7/1956 | Jones et al. . |
| 2,792,149 | 5/1957 | Lutz . |
| 2,802,608 | 8/1957 | Gassaway . |
| 2,954,738 | 10/1960 | Di Vette . |
| 2,999,499 | 9/1961 | Willet . |
| 3,067,787 | 12/1962 | Salk . |
| 3,148,624 | 9/1964 | Baldwin . |
| 3,165,241 | 1/1965 | Curry . |
| 3,199,787 | 8/1965 | Oishei et al. . |
| 3,295,144 | 1/1967 | Mengers . |
| 3,633,642 | 1/1972 | Siegel . |
| 3,796,245 | 3/1974 | Wildensteiner . |
| 3,819,151 | 6/1974 | Kish . |
| 3,822,720 | 7/1974 | Souza . |
| 4,089,447 | 5/1978 | Achmeteli . |
| 4,090,650 | 5/1978 | Gotta . |
| 4,095,812 | 6/1978 | Rowe . |
| 4,139,130 | 2/1979 | Glusker et al. . |
| 4,148,420 | 4/1979 | Morrissette et al. . |
| 4,153,092 | 5/1979 | Haslam . |
| 4,159,790 | 7/1979 | Bailey . |
| 4,176,772 | 12/1979 | Danon . |
| 4,189,075 | 2/1980 | Hall . |
| 4,253,454 | 3/1981 | Warncke . |
| 4,265,381 | 5/1981 | Muscatell . |
| 4,274,566 | 6/1981 | Rowe . |
| 4,345,704 | 8/1982 | Boughton . |
| 4,420,097 | 12/1983 | Motsenbocker . |
| 4,449,654 | 5/1984 | Cappis . |
| 4,469,097 | 9/1984 | Kelman . |
| 4,526,298 | 7/1985 | Boxer et al. . |
| 4,541,117 | 9/1985 | Ashbeck . |
| 4,544,087 | 10/1985 | Modig . |
| 4,617,685 | 10/1986 | Grandis . |
| 4,629,098 | 12/1986 | Eger . |
| 4,739,905 | 4/1988 | Nelson . |
| 4,739,913 | 4/1988 | Moore . |
| 4,758,099 | 7/1988 | Branson . |
| 4,776,495 | 10/1988 | Vignot . |
| 4,852,781 | 8/1989 | Shurnick et al. . |
| 4,941,598 | 7/1990 | Lambelet, Jr. et al. . |
| 4,948,023 | 8/1990 | Tripp . |
| 5,060,833 | 10/1991 | Edison et al. . |
| 5,062,591 | 11/1991 | Runkel . |
| 5,085,349 | 2/1992 | Fawcett . |
| 5,104,016 | 4/1992 | Runkel . |
| 5,114,059 | 5/1992 | Thatcher . |
| 5,115,947 | 5/1992 | McDonnell et al. . |
| 5,142,702 | 9/1992 | Piloian . |
| 5,143,266 | 9/1992 | Heckerman et al. . |
| 5,152,442 | 10/1992 | Gallagher . |
| 5,152,443 | 10/1992 | Hagan . |
| 5,215,231 | 6/1993 | Paczonay . |
| 5,228,609 | 7/1993 | Gregory . |
| 5,282,557 | 2/1994 | McCook . |
| 5,288,150 | 2/1994 | Bearman . |
| 5,301,858 | 4/1994 | Hollander . |
| 5,353,975 | 10/1994 | Libertucci . |
| 5,400,934 | 3/1995 | Ducros . |
| 5,407,112 | 4/1995 | Christodoulou et al. . |
| 5,427,290 | 6/1995 | Thatcher . |
| 5,431,308 | 7/1995 | Tchen . |
| 5,497,923 | 3/1996 | Pearson et al. . |
| 5,566,869 | 10/1996 | Katz . |
| 5,586,703 | 12/1996 | Radar et al. . |
| 5,601,207 | 2/1997 | Paczonay . |
| 5,725,139 | 3/1998 | Smith . |
| 5,727,714 | 3/1998 | Fawcett . |
| 5,727,720 | 3/1998 | Thatcher . |
| 5,755,368 | 5/1998 | Bekkedahl . |
| 5,791,510 | 8/1998 | Paczonay . |
| 5,803,333 | 9/1998 | Fawcett . |
| 5,816,457 | 10/1998 | Croft . |

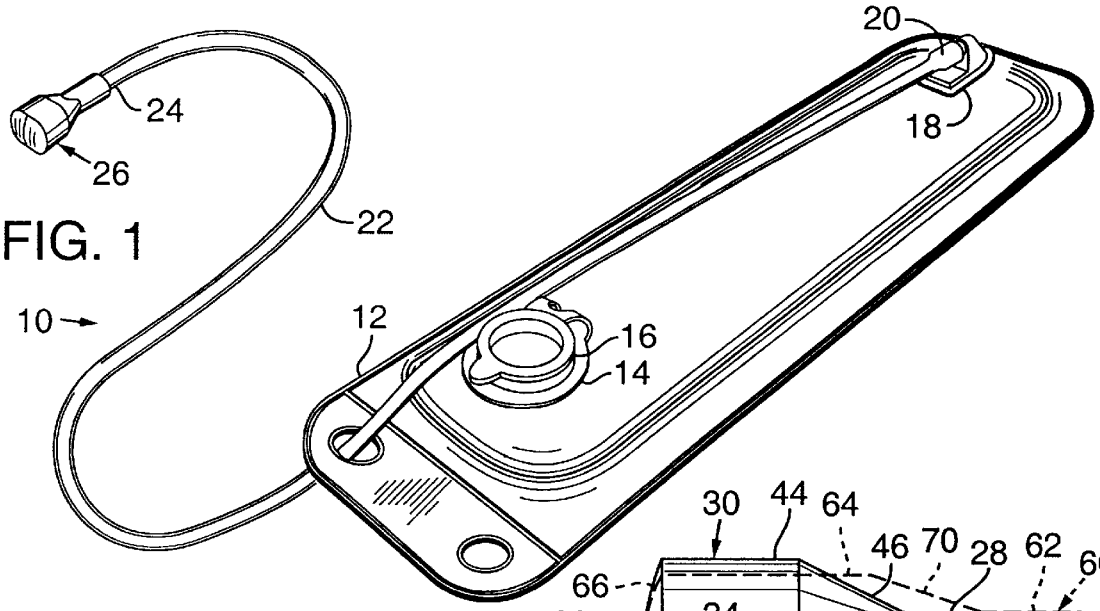
FIG. 1
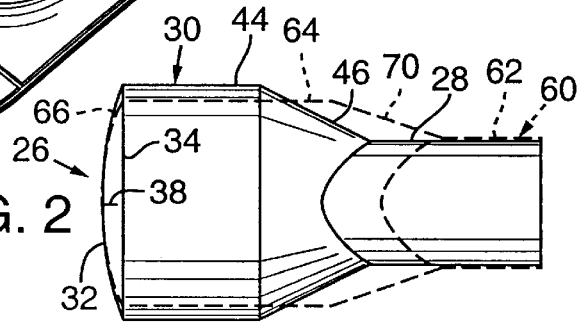
FIG. 2
FIG. 4
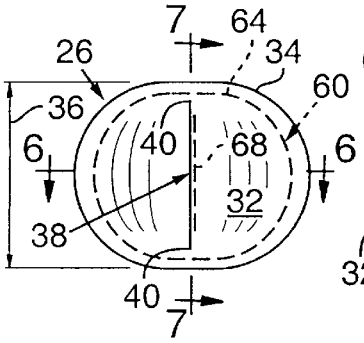
FIG. 3
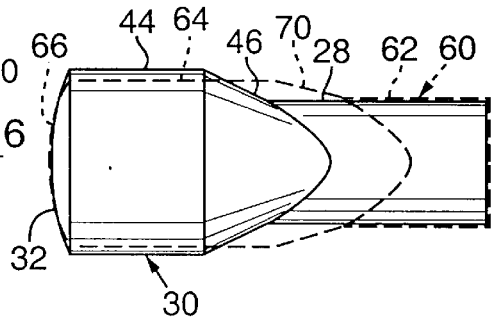
FIG. 5
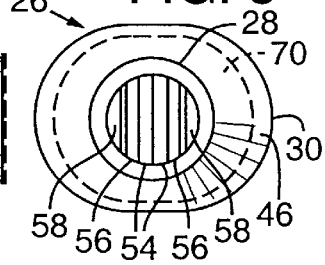
FIG. 6
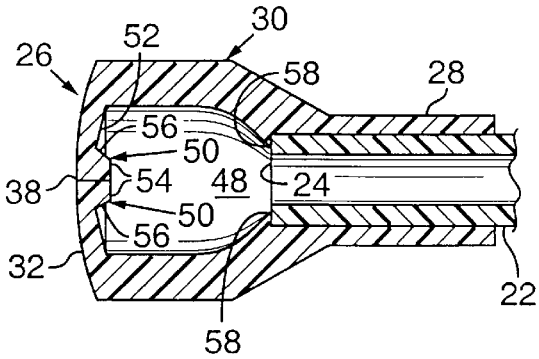
FIG. 7
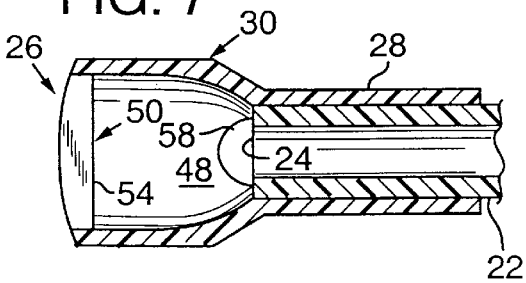

PERSONAL HYDRATION SYSTEM WITH AN IMPROVED MOUTHPIECE

RELATED APPLICATION

This is a continuation-in-part application of similarly-entitled, copending application Ser. No. 09/118,196, which was filed on Jul. 17, 1998.

FIELD OF THE INVENTION

The invention generally relates to personal hydration systems, and more particularly to a personal hydration system with an improved mouthpiece.

BACKGROUND AND SUMMARY OF THE INVENTION

Medical research has demonstrated the importance of maintaining adequate hydration while engaging in strenuous physical activities, such as bicycling or mountain climbing. In the not too distant past, participants in such activities carried their water in bottles or canteens from which they drank periodically. More recently, personal hydration systems have been developed which allow users to drink more or less continuously while engaged in sporting or recreational activities. These personal hydration systems typically have a bag-like fluid reservoir that is carried in a back- or waist-mounted pack. A long flexible hose is connected to the reservoir through an exit port at one end and terminates in a mouthpiece at the other end. The hose is long enough to allow the mouthpiece to be carried in the user's mouth to enable the user to draw water from the reservoir at will. Examples of these hydration systems are disclosed in U.S. Pat. Nos. 5,727,714, 5,060,833 and 5,085,349, the disclosures of which are hereby incorporated by reference.

Although personal hydration systems have proven to be a great advance over traditional water bottles, they do suffer from some drawbacks. In particular, it is often difficult for the user to quickly draw an acceptable flow of water from the reservoir. It should be understood that every breath the user spends drawing fluid from the reservoir is one less breath that can be used to deliver oxygen to the user's body. Therefore, there is a need for a mouthpiece that is capable of delivering an increased flow of fluid over conventional mouthpieces, which generally require multiple breaths to be used to draw a sufficient amount of fluid from the system.

Furthermore, it is desirable for the mouthpiece not to leak when in a closed position and to remain comfortably in a ready-to-use position in the user's mouth, even when not being used to dispense fluids. Simply scaling the size of conventional mouthpieces has not solved the flowrate problem because the enlarged designs tend to leak fluid when they should otherwise be in a closed position. This not only diminishes the user's fluid supply, but also leaks fluid onto the user and other surrounding objects.

The present invention is a personal hydration system with an improved mouthpiece. The mouthpiece includes a neck that is coupled to the supply tube of a hydration system and adapted to receive a flow of fluid therefrom. The neck is joined to a resilient head that is adapted to be received within a user's mouth and which preferably is of larger cross-section than the neck. The head includes a dispensing face with a pair of lips that form a normally closed slit through which fluid is selectively dispensed from the mouthpiece. From a closed position in which the lips extend against each other to close the slit and prevent fluid from being dispensed through the slit, the mouthpiece is defornable to a dispensing position in which the lips are spread at least partially away from each other to allow fluid to be dispensed through the lips. The face has a perimeter and a minimum dimension between opposed points on the perimeter. From the perimeter, a bite region extends to a shoulder that joins the bite region to the neck. Typically, the mouthpiece is placed in the user's mouth so that the user's lips extend around the neck portion and against the lip-receiving shoulder to retain the mouthpiece in the user's mouth in this position, the user's teeth are positioned to bite down upon the bite region to deform the mouthpiece to the dispensing position and thereby enable fluid to be dispensed to the user. The mouthpiece is adapted to selectively deliver fluid at a flowrate greater than presently available through known mouthpieces.

Many other features of the present invention will become manifest to those versed in the art upon making reference to the detailed description which follows and the accompanying sheets of drawings in which preferred embodiments incorporating the principles of this invention are disclosed as illustrative examples only.

BRIEF DESCRIPTION OF THE DRAWINGS

FIG. 1 is a perspective view of a personal hydration system with a mouthpiece constructed according to the present invention.

FIG. 2 is a top plan view of the mouthpiece of FIG. 1 with a prior art mouthpiece shown in dashed lines.

FIG. 3 is a side elevation view of the mouthpieces of FIG. 2.

FIG. 4 is a front elevation view of the mouthpieces of FIG. 2.

FIG. 5 is a rear elevation view of the mouthpieces of FIG. 2.

FIG. 6 is a top cross-sectional view of the mouthpiece of FIG. 1 taken along the line 6—6 in FIG. 4 and showing the mouthpiece in a closed position.

FIG. 7 is a side cross-sectional view of the mouthpiece of FIG. 1 taken along the line 7—7 in FIG. 4 and showing the mouthpiece in a closed position.

DETAILED DESCRIPTION OF THE PREFERRED EMBODIMENTS

Figure 8:
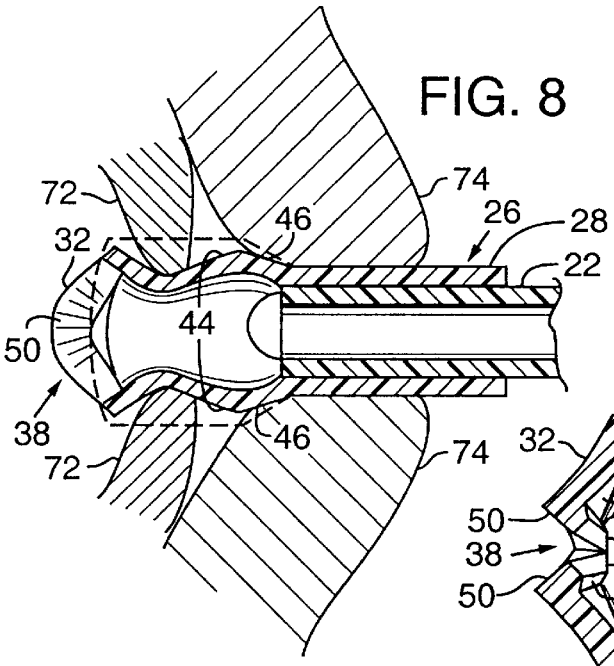
FIG. 8 is an environmental view showing the mouthpiece of FIG. 1 positioned in a user's mouth in a dispensing position, with the mouthpiece shown in a side cross-sectional view.

A personal hydration system according to the present invention is shown generally at 10 in FIG. 1. System 10 includes a fluid reservoir, or bladder, 12 for storing fluid (such as water, juice, etc.). Bladder 12 is preferably flexible and may vary in size and shape depending on the volume of fluid to be carried by the user and the shape of the pack or other storage pack into which the bladder is stored when carried by a user. Bladder 12 includes an input port, such as a sealable filler spout 14 with a cap 16, which can be opened to empty, fill or clean the bladder. Bladder 12 also includes an exit port 18 onto which one end 20 a flexible hose 22 is mounted. Hose 22 is of sufficient length to extend from bladder 12 in its stowed position, typically on a user's back, to the user's mouth.

The other end 24 of hose 22 is connected to a mouthpiece 26, which is sized to be received within the user's mouth to deliver fluid to the user. Mouthpiece 26 is shown in more detail in FIGS. 2–7. Mouthpiece 26 includes a neck 28 which is connected to and in fluid communication with end 24 of hose 22. As shown in FIG. 6, neck 28 is fit over end 24 of hose 22 and forms a watertight seal. It should be noted that the mouthpiece can be slipped on and off the hose for cleaning or maintenance.

Mouthpiece 26 further includes a head 30, which typically is of larger cross-section than neck 28 and which includes a dispensing face 32 through which fluid is selectively dispensed from the mouthpiece. Dispensing face 32 has a perimeter 34 with a minimum dimension measured from opposed points on the perimeter, as indicated at 36 in FIG. 4. Dispensing face 32 further includes an elongate, normally closed slit 38 through which fluid is dispensed from the mouthpiece. Slit 38 is described in more detail subsequently, but as shown, extends substantially across face 32 and includes ends 40 adjacent perimeter 34.

From perimeter 34, head 30 includes a body region, referred to herein as a bite region, 44 that extends generally normal to the plane of perimeter 34 and provides a surface upon which the user may apply a force, such as with the user's teeth, to deform mouthpiece 26 to open slit 38 and enable a flow of fluid to be dispensed from the mouthpiece. Dispensing face 32 and bite region 44 collectively form a supply chamber 48 into which the flow of fluid is housed before being dispensed to the user. By comparing FIGS. 3 and 4, it can be seen that the length of bite region 44 is less than minimum dimension 36. Typically, bite region 44 has a length that is less than approximately one inch, preferably less than approximately 0.7 inches, more preferably less than 0.6 inches and even more preferably between approximately 0.6 and approximately 0.4 inches. For example, a bite region that is 0.5 inches in length has proven to work well, both from manufacturing and ease-of-use standpoints.

Bite region 44 terminates at a lip-receiving shoulder 46 that connects the bite region with neck 28. Lip-receiving shoulder 46 may also be referred to as a transition region because, as shown in FIGS. 3–4, it extends at an angle between the smaller cross-sectional dimension of neck 28 and the larger cross-sectional dimension of head 30. Shoulder 46 provides a surface upon which a user's lips may be placed when the mouthpiece is used. As shown, shoulder 46 extends generally at an angle of approximately 60° between bite region 44 and neck 28. It should be understood that it is within the scope of the present invention that the shoulder may extend at other angles and may have different shapes, such as curved, concave, convex, etc., as it extends between region 44 and neck 25. An angle of 60° is presently preferred because it provides a comfortable lip-receiving shoulder and also is not too steep to prevent the core pin currently used in the manufacturing process to be removed.

In FIGS. 5–7, it can be seen that slit 38 is formed between a pair of opposed lips 50, which extend across perimeter 34. As shown, lips 50 extend in the direction of the dispensing face's minimum dimension 36, however, it is within the scope of the present invention that the lips, and therefore the slit defined therebetween, could extend across face 32 in other directions as well, such as transverse to the minimum dimension. Lips 50 further extend from the inner surface 52 of the dispensing face into supply chamber 48 to provide an area of increased contact between the lips. This helps prevent fluid from passing through slit 38 other than when the user intends for fluid to be dispensed.

As perhaps best seen in FIGS. 5 and 6, the portion of lips 50 extending within supply chamber 48 includes an end wall 54 and a tapered side wall 56 extending at an angle between end wall 54 and inner surface 52. This angle may vary between approximately 0° and approximately 75°, with a preferred value of between approximately 30° and approximately 60° and a more preferred value of approximately 45°. An angle of 45° is presently preferred because it produces a generally laminar flow of fluid through the slit when the mouthpiece is in the dispensing position, which is discussed in more detail subsequently. In FIGS. 2–7, lips 50 extend against each other to close slit 38 and prevent fluid from being dispensed therethrough. This position is referred to as the closed position of the mouthpiece, and is the resting position to which the resilient mouthpiece and lips return when any applied force is removed.

Mouthpiece 26 preferably includes a pair of stops 58 that extend internally into mouthpiece 26 to prevent supply tube 22 from being inserted into mouthpiece 26 more than a defined distance. For example, as shown in FIGS. 5–7, stops 58 extend into supply chamber 48 to engage end 24 of supply tube 22 and prevent it from being inserted into the supply chamber of mouthpiece 26. Also shown in FIGS. 6 and 7 are the thicknesses of the side walls of mouthpiece 26. It should be understood that they may vary in relative size depending on the particular materials of construction and sizes of core pins and dies used in the molding process to form mouthpiece 26.

A prior art mouthpiece is shown in dashed lines in FIGS. 2–5 and indicated generally at 60. As shown, prior art mouthpiece 60 has many of the same general elements as mouthpiece 26, such as a neck 62, head 64, dispensing face 66, slit 68, bite region 70 and transition region 72. However, prior art mouthpiece 60 has a longer length, yet shorter slit, height and width than mouthpiece 26. By comparison, head 26 is approximately 20% higher and wider than the prior art mouthpiece, yet is approximately 33% shorter in length. Furthermore, head 26 produces a flowrate that is approximately 100% greater than the flowrate through the prior art mouthpiece, yet has a supply chamber than is approximately 33% smaller in volume. For purposes of more detailed comparison, the presently preferred dimensions of mouthpiece 26 are compared below to the dimensions of the prior art mouthpiece. It should be understood that dimensions other than those presented below are within the scope of the present invention.

Head 26 has a circumference of approximately 2.219 inches and is approximately 0.6 inches high and 0.77 inches wide, with side walls that are approximately 0.5 inches in length and approximately 0.05 inches and 0.140 inches thick, respectively. Slit 40 is between approximately 0.445 inches and approximately 0.485 inches long, and head 32 has a supply chamber between face 32 and transition region 46 with a volume of approximately 0.1412 cubic inches. The prior art mouthpiece, on the other hand has a head 64 with a circumference of approximately 1.932 inches and is approximately 0.5 inches high and 0.67 inches wide, with side walls that are approximately 0.74 inches in length and approximately 0.0425 inches and 0.125 inches thick, respectively. Slit 68 is approximately 0.38 inches long, and head 64 defines a supply chamber between face 66 and transition region 70 with a volume of approximately 0.1885 cubic inches.

The increased cross-sectional area transverse to the direction of fluid flow, coupled with the larger slit enables mouthpiece 26 to dispense fluid at a much higher flowrate. In the dispensing position, such as shown in FIG. 10, the slit forms an opening that is sized to enable fluid to be dispensed at a flowrate greater than 30 ml/sec, and more preferably greater than 40 ml/sec under normal operating conditions. In tests, a hydration system with the mouthpiece shown in FIGS. 1–10 has produced flowrates between approximately 35 ml/sec and approximately 45 ml/sec. More particularly, flowrates greater than 41 ml/sec are possible, as compared to a flowrate of 18 ml/sec with the prior art mouthpiece under normal operating conditions. By normal operating conditions, it is meant that the mouthpiece is placed in a user's mouth, urged to the dispensing position described herein, and drawn or sucked upon by the user, much like a person draws upon a drinking straw. This more than twofold increase in flowrate means that a user has to expend less than half as many breaths to draw a desired volume of fluid through the mouthpiece.

In the dispensing position shown in FIG. 10, slit 40 has an area that is greater than 50% of the cross-sectional area of neck 28 (measured transverse to the direction of fluid flow from the inner wall of the neck). Preferably, the area of the slit in the dispensing position is greater than 60% of the area of the neck. As shown in FIG. 10, the slit area is between approximately 50% and approximately 70% of the area of the neck and more particularly between approximately 55% and approximately 65% of the area of the neck. More breaths devoted to breathing means more oxygen to the user's body, which should thereby increase performance.

In addition to increasing the flowrate of fluid from mouthpiece 26, the dimensions of the mouthpiece also make it more comfortable to use. When the mouthpiece is placed in an operative position in the user's mouth, as shown in FIG. 8, bite region 44 is positioned generally between the user's teeth 74, and the user's lips 76 are naturally seated against lip-receiving shoulder 46 and around neck 28. By naturally seated, it is meant that the user's lips fall into this position, without requiring the user to stretch his or her lips to extend around head 30 or to over-insert mouthpiece 26 into his or her mouth. The spacing of shoulder 46 from dispensing face 32 not only makes mouthpiece 26 much more comfortable to use (because the user's mouth can remain substantially in its normal closed position), but also enables the mouthpiece to more easily be retained in a preferred operative position, as compared to prior art mouthpiece 60. Because of its longer head 64, a user's lips are naturally seated on bite region 70 of prior art mouthpiece 60 instead of transition region 72. In this position, mouthpiece 60 will tend to slip further into or out of the user's mouth unless constant pressure is provided by the user's teeth and/or lips. Furthermore, mouthpiece 60 will tend to pivot within the user's mouth about the regions of constant pressure.

If, on the other hand, the prior art mouthpiece is positioned in the user's mouth so that the user's lips extend around the neck, then the user's teeth will not be properly positioned to bite down upon the "sweet spot" of the head. It should be understood that the bite regions of both mouthpieces have what is referred to as a "sweet spot" or region of less resistance upon which the user can most easily apply force to cause the mouthpiece to deform to its dispensing position. With both mouthpieces 26 and 60, the sweet spot is generally between the dispensing region and transition region. With mouthpiece 26, placing the mouthpiece within the user's mouth so that the user's lips 76 are seated on shoulder 46 automatically positions the sweet spot in a position to be engaged by the user's teeth 74. In prior art mouthpiece 60, placing the user's lips on transition region 72 results in the user's teeth being off-center from the sweet spot. Therefore, the mouthpiece must be repositioned prior to use.

Figure 9:
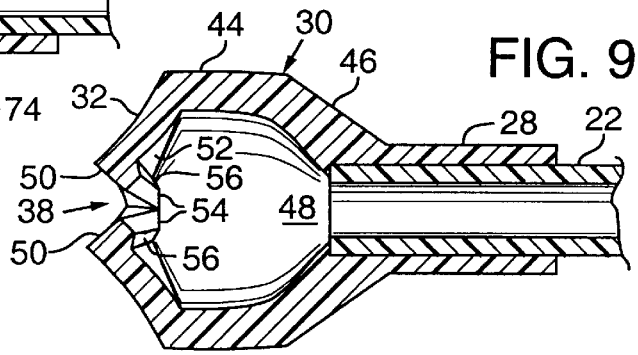
FIG. 9 is a top cross-sectional view of the mouthpiece of FIG. 8.
Figure 10:
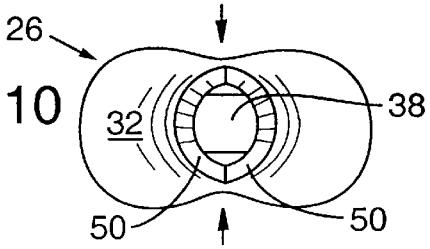
FIG. 10 is a front view of the mouthpiece of FIG. 8.
Figure 11:
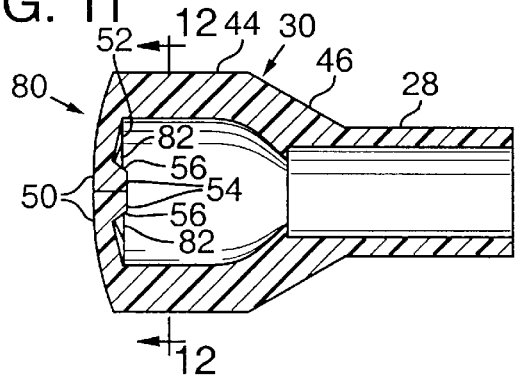
FIG. 11 is a side cross-sectional view of an alternate embodiment of the mouthpiece of FIG. 1 in a closed position.
Figure 12:
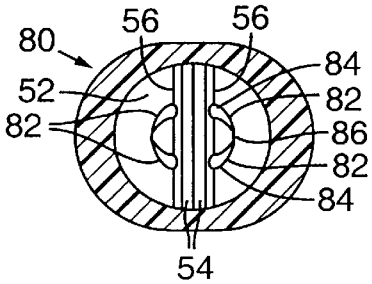
FIG. 12 is a cross-sectional view of the mouthpiece of FIG. 11 taken along the line 12—12 in FIG. 11.
Figure 13:
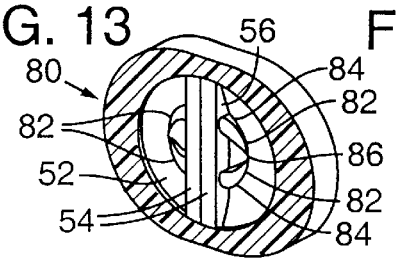
FIG. 13 is a perspective view of the portion of the mouthpiece shown in FIG. 12.
Figure 14:
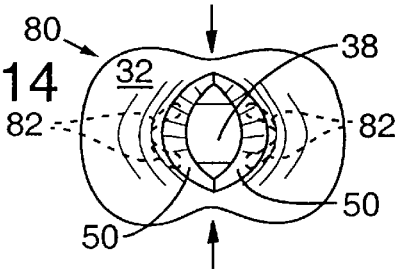
FIG. 14 is a front elevation view of the mouthpiece of FIG. 11 in a dispensing position.

Once positioned in the user's mouth as discussed above, mouthpiece 26 can be deformed from its closed position to a dispensing position, shown in FIGS. 8–10, when a force is applied to the regions of bite region 44 generally adjacent ends 40 of slit 38. This compressive force is applied along the axes of the lips, as indicated generally with arrows in FIG. 10, and causes lips 50 to spread at least partially apart from each other to cause slit 38 to form an opening, also referred to as a hydraulic orifice, through which fluid may be passed. As used here, the term dispensing position broadly refers to any of the positions in which the lips are spread at least partially apart from each other so that the slit forms an opening through which fluid may be dispensed. It should be understood that the size of the opening formed by slit 38 will vary depending upon the amount of force applied by the user.

Once in a dispensing position, the user may draw fluid through the mouthpiece, much like the user would draw upon a drinking straw. As discussed, this is referred to as the normal operating condition for using mouthpiece 26 and any attached hydration system. When this force is removed, the resilient nature of mouthpiece 26, and more particularly, head 32 and lips 50 causes the mouthpiece to return to its closed, non-dispensing position. An example of a suitable material for mouthpiece 26 is fifty-five durometer silicone, although it is within the scope of the invention that other materials may be used as well, as long as they meet the operating criteria discussed herein.

In FIGS. 11–14, an alternate embodiment of the invented mouthpiece is shown and indicated generally at 80. Mouthpiece 80 has the same components and subcomponents as the previously described mouthpiece 26. In addition, mouthpiece 80 includes a plurality of resilient supporting ribs 82 that extend from lips 50 to provide increased protection against leaks by biasing the lips to return to their closed position. As perhaps best seen in FIGS. 12 and 13, a rib 82 extends from each lip 50, and more particularly from side wall 56 of each lip along inner surface 52 of dispensing face 32. It should be understood, however, that it is within the scope of the invention that ribs 82 could alternatively extend along the outer surface of face 32. Each rib 82 extends from a respective one of the lips at a first position, and returns to the lip at a second position spaced-apart from the first. When mouthpiece 80 is in its dispensing position, ribs 82 are bent or deformed from the resting position shown in FIGS. 12 and 13 to a dispensing position shown in FIG. 14. As such, ribs 82 further bias the mouthpiece, and especially face 32 and lips 50 to return to the closed position. Preferably, ribs 82 include ends 84 that extend from lips 50 as described above and taper to an intermediate region 86 of narrower cross-section than ends 84. The reduced size of intermediate region 86, which extends in a portion of face 32 that undergoes significant bending or deformation, minimizes the amount of additional force needed to deform mouthpiece 80 to its dispensing position, while still providing a continuous, curved support for lips 50. In variations of this embodiment, intermediate region 86 is substantially or completely coplanar with inner surface 52.

Figure 15:
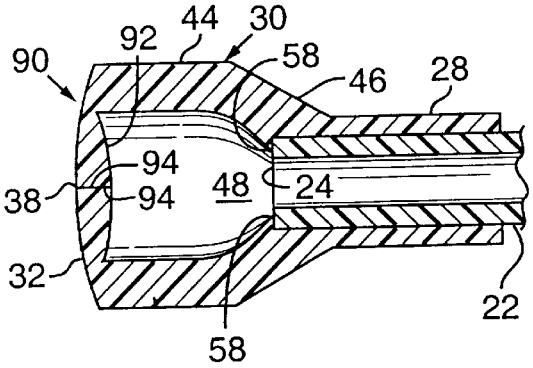
FIG. 15 is a side cross-sectional view of another alternate embodiment of the mouthpiece of FIG. 1.
Figure 16:
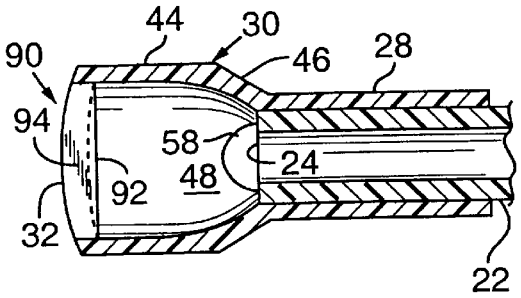
FIG. 16 is a top cross-sectional view of the mouthpiece of FIG. 15.
Figure 17:
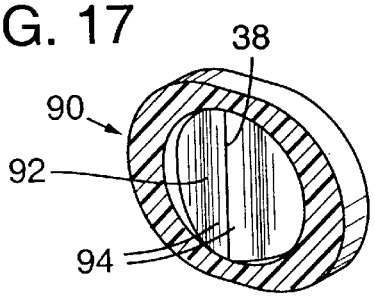
FIG. 17 is a cross-sectional view of the mouthpiece of FIG. 15.
Figure 18:
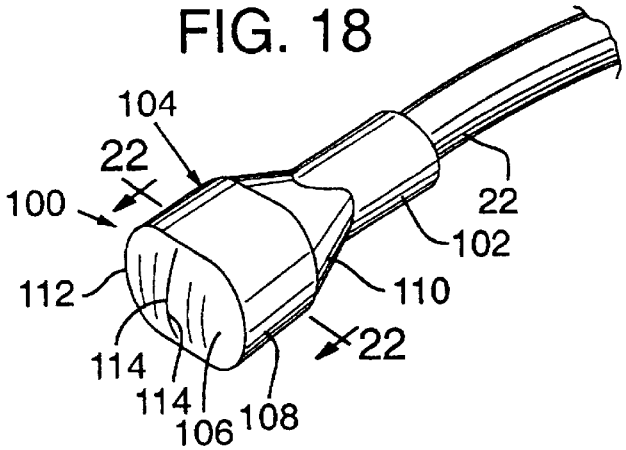
FIG. 18 is an isometric view of another embodiment of the mouthpiece of FIG. 1.

In FIGS. 15–17, another alternate embodiment of the invented mouthpiece is shown and indicated generally at 90. Unless otherwise indicated, mouthpiece 90 has the same components, dimensions and properties as mouthpiece 26, including a neck 28 and a head 30 that includes a dispensing face 32 (with a pair of lips that define a normally closed slit 38), a bite region 44, a transition region 46, and a supply chamber 48 defined by the dispensing face and the bite region. In FIGS. 15–17, the inner surface of face 32 is generally indicated at 92, and it can be seen that surface 92 has a convex cross-sectional configuration generally transverse to slit 38.

As shown, the thickness of face 32 distal slit 38 is between approximately 0.06 inches and approximately 0.14 inches, similar to the faces of the previously discussed mouthpieces. A thickness distal slit 38 of approximately 0.8 inches has proven to perform particularly well. As surface 92 extends from bite region 44 toward slit 38, it can be seen in FIGS. 15 and 17 that face 32 increases in thickness and extends into the supply chamber until it forms a pair of lips 94 that define slit 38. The radius of curvature of surface 92 is approximately 0.75 inches, although it should be understood that larger or small radii of curvature may be acceptable as well.

Figure 19:
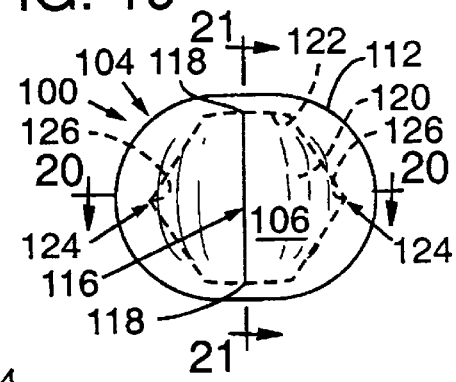
FIG. 19 is a front elevation view of the mouthpiece of FIG. 18.

Another embodiment of the present invention is shown in FIGS. 18–23 and indicated generally at 100. As shown, mouthpiece 100 has outer dimensions that correspond with the previously disclosed embodiments, including a neck 102 and a head 104 with a dispensing face 106, bite region 108 and lip-receiving shoulder 110. Face 106 extends to an outer perimeter 112, where it is joined to a bite region 108, and includes a pair of opposed lips 114 that define a slit 116 (indicated in FIG. 19) extending therebetween. As shown in FIG. 19, slit 116 is elongate and has a pair of ends 118 adjacent perimeter 112. Unless otherwise specified, mouthpiece 100 has the same elements and subelements as any of the above embodiments, including the shapes, 10 properties and possible variations discussed with respect to the mouthpieces shown in FIGS. 1–17.

Figure 20:
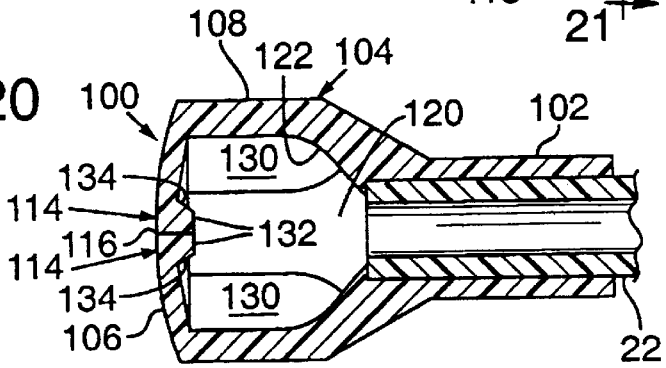
FIG. 20 is a top cross-sectional view of the mouthpiece of FIG. 18 taken along the line 20—20 in FIG. 19.
Figure 21:
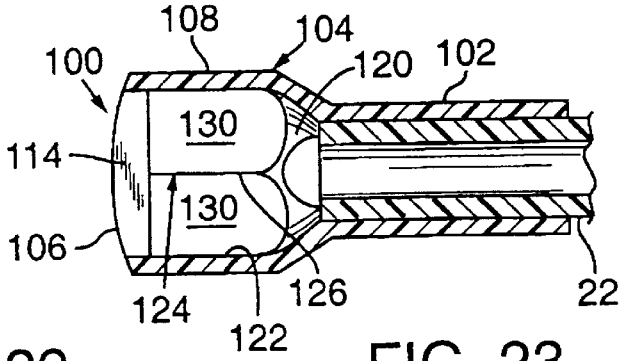
FIG. 21 is a side cross-sectional view of the mouthpiece of FIG. 18 taken along the line 21—21 in FIG. 19.

Similar to the above-described embodiments, bite region 108 extends from head 104 to form the internal surface, or side wall, 122 of a supply chamber 120, into which fluid is received prior to being dispensed from face 106. As shown in FIGS. 19–21, side wall 122 encircles the supply chamber and forms plural corners 124 distal slit 116. At their apexes 126, corners 124 define fold lines that extend away from face 106 generally transverse to slit 116. Side wall 122 may alternatively be described as including plural discontinuities because the otherwise smooth, or actuate, inner wall is broken by the apexes of the corners.

Figure 22:
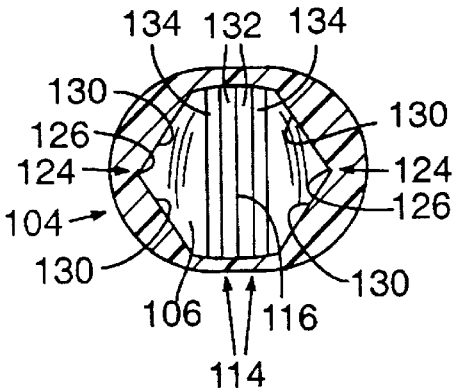
FIG. 22 is a cross-sectional view taken along the line 22—22 in FIG. 20.

As perhaps best seen in FIGS. 19 and 21, side wall 122 includes regions 130 that have generally planar configurations and meet to form apexes 126 distal slit 116. When mouthpiece 100 is deformed to its dispensing position, abutting regions 130 are pivoted toward each other about apex 126. Regions 130 give side wall 122 a generally polygonal configuration in a plane parallel to perimeter 112, and as shown in FIGS. 19 and 22, generally resembles a hexagon. It should be understood, however, that there may still be some curvature to portions of side wall 120. For example, a slight curvature proximate ends 118 of slit 116 promotes easier opening of slit 116 when a user bites upon bite region 104. Abutting regions 130 extend at an angle with respect to each other that is between approximately 80° and approximately 130°, preferably between approximately 90° and approximately 125°, and more preferably between approximately 100° and approximately 120°. Angles outside of this range are also within the scope of the present invention, however the above-discussed angular ranges are presently preferred. In mouthpiece 100 shown in FIGS. 19–22, regions 130 extend at an angle of approximately 114° with respect to each other, with side wall 120 having a thickness at apex 126 of approximately 0.16 inches. This thickness is measured from the supply chamber outwardly to the closest point on the outer surface of the bite region.

At apex 126 of each corner 124, bite region 108 has a reduced thickness than the corresponding regions adjacent apex 126. This thinner, generally pointed configuration of the apexes 126, along which the corresponding fold lines extend, enables the mouthpiece to flex or pivot about the apex to the dispensing position when a user bites upon region 108. Because of the reduced thickness at the apex, the mouthpiece deforms substantially by pivoting about the apex instead of by compressing a relatively thick, or even thickest, portion of the bite region. This enables the slit to create a hydraulic orifice with a larger area, without requiring the slit to be lengthened. Upon removal of the deforming force, the mouthpiece is biased to spring back to its original, unstressed position in which slit 116 is closed and no fluid is dispensed therethrough.

Experiments using mouthpiece 100 have demonstrated that fluid may be dispensed from dispensing face 106 at a rate greater than 40 ml/sec, including flowrates of approximately 45 ml/sec, under the normal operating conditions discussed previously.

Figure 23:
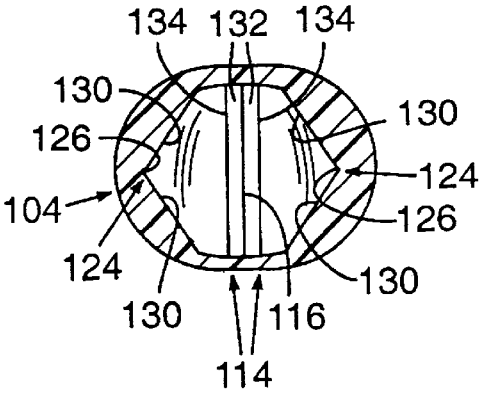
FIG. 23 is the cross-sectional view of FIG. 22 showing another variation of the lips of the mouthpiece.

As shown in FIGS. 20 and 22, lips 114 extend into supply chamber 120 beyond dispensing face 106. Furthermore, lips 114 include end walls 132 and side walls 134 that extend at an angle between face 106 and the corresponding end wall 132. End walls 132 and side walls 134 of lips 114 may include any of the configurations and shapes described above with respect to end walls 54 and side walls 56, including side walls that extend generally transverse to face 106, as shown in FIG. 23. Side walls that extend at an angle of between approximately 30° and approximately 60° are currently preferred because they promote more laminar flow of the fluid as it is received within supply chamber 120 and dispensed through slit 116, however, the invented lips encompass any of the configurations of lips disclosed herein.

The foregoing description of the preferred embodiments of the invention has been presented for purposes of illustration and description. It is not intended to be exhaustive or to limit the invention to the precise form disclosed, and many modifications and variations are possible in light of the above teaching. The embodiments were chosen and described in order to best explain the principles of the invention and its practical application to thereby enable others skilled in the art to best utilize the invention in various embodiments and with various modifications as are suited to the particular use contemplated. It is intended that the scope of the invention be defined by the claims appended hereto.

We claim:

1. A personal hydration system for use in providing fluid to a user, the hydration system comprising:

a reservoir configured to hold a supply of fluid and including an output port through which the fluid may be passed;

a flexible hose with first and second ends, the first end being connected to the output port; and a mouthpiece connected to the second end of the hose and configured to be placed in the user's mouth to provide fluid delivery thereto, the mouthpiece comprising:

a neck portion mounted on the second end of the hose; and a head joined to the neck and adapted to be received in a user's mouth, the head including a dispensing face with a slit through which fluid is selectively dispensed from the mouthpiece, and a body region extending away from the face and including an interior surface which defines a supply chamber into which fluid is received prior to being dispensed from the mouthpiece, the internal surface including plural corners with apexes distal the slit.

2. The hydration system of claim 1, wherein the corners extend along the surface in a direction generally transverse to the face.

3. The hydration system of claim 2, wherein the corners extend along at least a substantial portion of the length of the surface.

4. The hydration system of claim 1, wherein each comer further includes generally planar regions proximate its apex.

5. The hydration system of claim 4, wherein the thickness of the body region at each apex is less than the thickness proximate each apex.

6. The hydration system of claim 1, wherein each comer includes a region of reduced thickness distal the slit.

7. The hydration system of claim 6, wherein the region of reduced thickness is at the apex of each corner.

8. A personal hydration system for use in providing fluid to a user, the hydration system comprising:

a reservoir configured to hold a supply of fluid and including an output port through which the fluid may be passed;

a flexible hose with first and second ends, the first end being connected to the output port; and a mouthpiece connected to the second end of the hose and configured to be placed in the user's mouth to provide fluid delivery thereto, the mouthpiece comprising:

a neck portion mounted on the second end of the hose; and a head joined to the neck and adapted to be received in a user's mouth, the head including a dispensing face with a slit through which fluid is selectively dispensed from the mouthpiece, and a body region extending away from the face and including an interior surface which defines a supply chamber into which fluid is received prior to being dispensed from the mouthpiece, the internal surface including plural generally planar regions extending generally transverse to the face.

9. The hydration system of claim 8, wherein the planar regions are joined together at an apex extending transverse to the face distal the slit.

10. The hydration system of claim 9, wherein the apex is adapted to provide an axis about which the planar regions are pivoted toward each other when the mouthpiece is deformed to the dispensing position.

11. The hydration system of claim 8, wherein the mouthpiece is adapted to deliver fluid to the user under normal operating conditions at a flowrate greater than 40 ml/sec.

12. A personal hydration system for use in providing fluid to a user, the hydration system comprising:

a reservoir configured to hold a supply of fluid and including an output port through which the fluid may be passed;

a flexible hose with first and second ends, the first end being connected to the output port; and a mouthpiece connected to the second end of the hose and configured to be placed in the user's mouth to provide fluid delivery thereto, the mouthpiece comprising:

a neck portion mounted on the second end of the hose; and a head adapted to be received in a user's mouth and including a dispensing face with a slit, a perimeter and a minimum dimension between opposed points on the perimeter, wherein the head further includes a bite region extending from the perimeter generally toward the neck to a lip-receiving shoulder, the lip-receiving shoulder extends from the bite region to the neck, and the bite region has a length measured from the perimeter to the lip-receiving shoulder which is less than the minimum dimension, and further wherein the bite region includes an internal surface with plural corners, each comer including an apex distal the slit.

13. The hydration system of claim 12, wherein the corners extend along the surface and away from the dispensing face, with the apex defining an axis extending generally transverse to the face.

14. The hydration system of claim 13, wherein each corner includes abutting regions forming the apex, said regions being pivoted toward each other about the axis when the mouthpiece is urged from the closed position to the dispensing position.

15. The hydration system of claim 12, wherein the corners extend along at least a substantial portion of the surface.

16. A hydration system for use in providing fluid to a user, the hydration system comprising:

a reservoir configured to hold a supply of fluid and including an output port through which the fluid may be passed;

a flexible hose with first and second ends, the first end being connected to the output port; and a mouthpiece connected to the second end of the hose and configured to be placed in the user's mouth to provide fluid delivery thereto, the mouthpiece comprising:

a neck adapted to receive a supply of fluid from the hydration system and having an inner wall that defines a cross-sectional area measured transverse to the direction of fluid flow; and a resilient head in fluid communication with the neck and having a dispensing face with a pair of lips defining a normally closed slit extending therebetween to provide a sealable opening through which fluid is selectively dispensed when the lips are urged from a closed position, in which the lips extend against each other to close the slit and prevent fluid from being dispensed therethrough, to a dispensing position, in which the lips are spread at least partially away from each other to enable fluid to be dispensed through the slit, wherein in the dispensing position the slit forms an opening with an area that is at least 50% of the area of the neck, wherein the bite region includes an internal surface defining a supply chamber into which fluid is received prior to being dispensed through the dispensing face, and further wherein the internal surface includes plural discontinuities.

17. The hydration system of claim 16, wherein the internal surface includes plural corners, each having an apex distal the slit.

18. The hydration system of claim 17, wherein each apex extends generally transverse to the face along at least a substantial portion of the surface.

* * * * *